US005871115A

United States Patent [19]

Kohn

[11] Patent Number: 5,871,115

[45] Date of Patent: Feb. 16, 1999

[54] ARTICLE SUPPORTING AND DISPENSING APPARATUS

[76] Inventor: Albert Kohn, 83 Wood La., Woodsburgh, N.Y. 11598

[21] Appl. No.: 967,260

[22] Filed: Nov. 7, 1997

Related U.S. Application Data

[63] Continuation of Ser. No. 549,625, Oct. 27, 1995, abandoned.

[51] Int. Cl.[6] ..... A47F 5/01; B65D 6/08

[52] U.S. Cl. ..... 220/485; 211/59.1; 211/181; 220/481; 206/506; 206/509

[58] Field of Search ..... 220/481, 486, 220/491, 480; 206/509, 510, 513, 506; 211/54.1, 57.1, 59.1, 181; 248/95, 241

[56] References Cited

U.S. PATENT DOCUMENTS

| | | | |
|---|---|---|---|
| Re. 33,122 | 12/1989 | Orem . | |
| 1,938,025 | 12/1933 | Kelly | 220/486 X |
| 2,645,359 | 3/1953 | Jewell . | |
| 3,184,075 | 5/1965 | Cohen | 211/181 X |
| 3,312,339 | 4/1967 | Million . | |
| 3,454,166 | 7/1969 | Dinges . | |
| 3,770,134 | 11/1973 | Kupcikevicius . | |
| 3,777,930 | 12/1973 | Ericson et al. . | |
| 3,887,073 | 6/1975 | Wilson . | |
| 3,918,589 | 11/1975 | Nausedas . | |
| 4,079,836 | 3/1978 | Von Stein et al. . | |
| 4,298,127 | 11/1981 | Upshaw et al. | 306/513 X |
| 4,407,473 | 10/1983 | Howe, Jr. . | |
| 4,579,307 | 4/1986 | Malik . | |
| 4,724,967 | 2/1988 | Valiulis . | |
| 4,750,694 | 6/1988 | Bateman . | |
| 4,759,639 | 7/1988 | Dematteis . | |
| 4,785,971 | 11/1988 | Konarik . | |
| 4,821,885 | 4/1989 | Ondrasik . | |
| 5,031,783 | 7/1991 | Goudreau . | |
| 5,038,943 | 8/1991 | Reinke . | |
| 5,123,537 | 6/1992 | Gresens | 206/513 X |
| 5,152,407 | 10/1992 | Massoudnia et al. . | |
| 5,184,728 | 2/1993 | Wile . | |
| 5,301,832 | 4/1994 | Daniels . | |
| 5,332,097 | 7/1994 | Wile . | |
| 5,383,562 | 1/1995 | Gay . | |
| 5,503,277 | 4/1996 | O'Brien | 211/59.1 X |
| 5,584,402 | 12/1996 | Johnson | 211/181 X |

*Primary Examiner*—Stephen J. Castellano
*Assistant Examiner*—Niki M. Kopsidas
*Attorney, Agent, or Firm*—Graham & James LLP

[57] ABSTRACT

An apparatus for supporting and dispensing articles such as bags includes a plurality of article supporting and dispensing racks that include a rack insert receiving member and a rack insert member on at least one end portion of each rack so that the racks can be stacked for holding and dispensing different sizes of articles. Each of the racks is provided with hooks that are removably and adjustably mounted on the respective racks. The hooks are adapted to be quickly and easily mounted on and removed from each of the racks so that the hooks can be positioned on a respective rack at selected positions to accommodate different size bags or articles. A locking member may be provided for locking at least two stacked racks to each other.

9 Claims, 2 Drawing Sheets

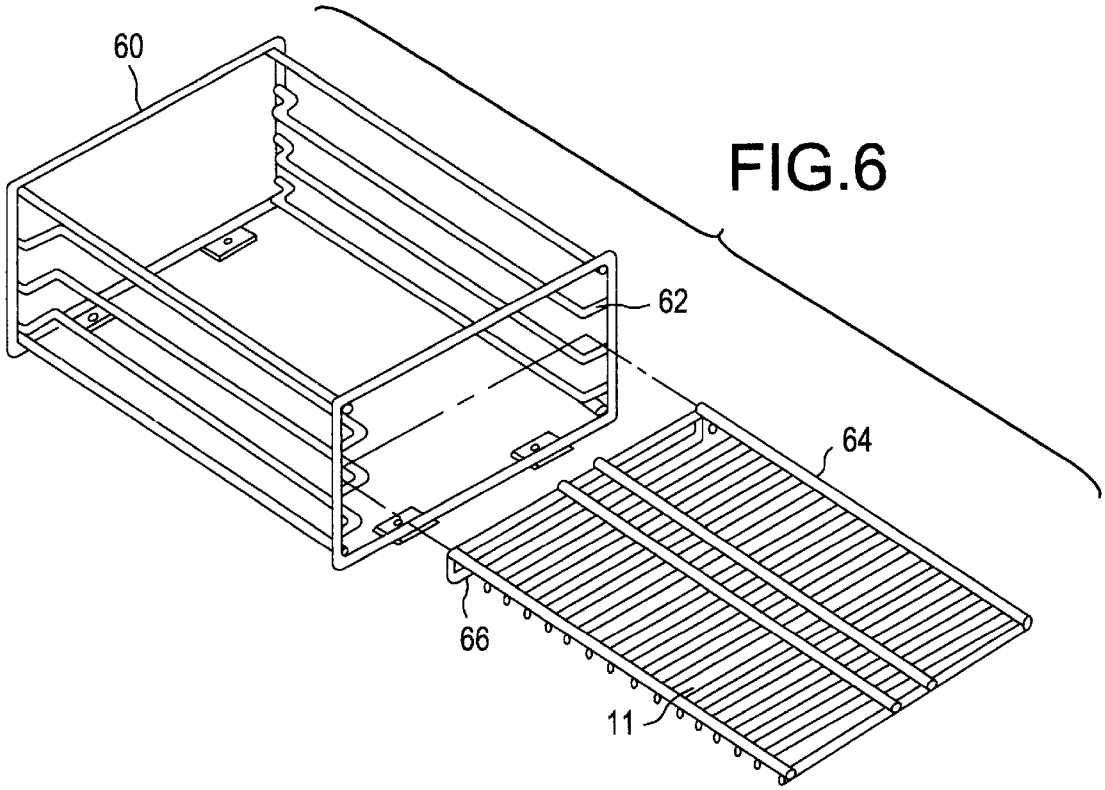
FIG.6
FIG.5
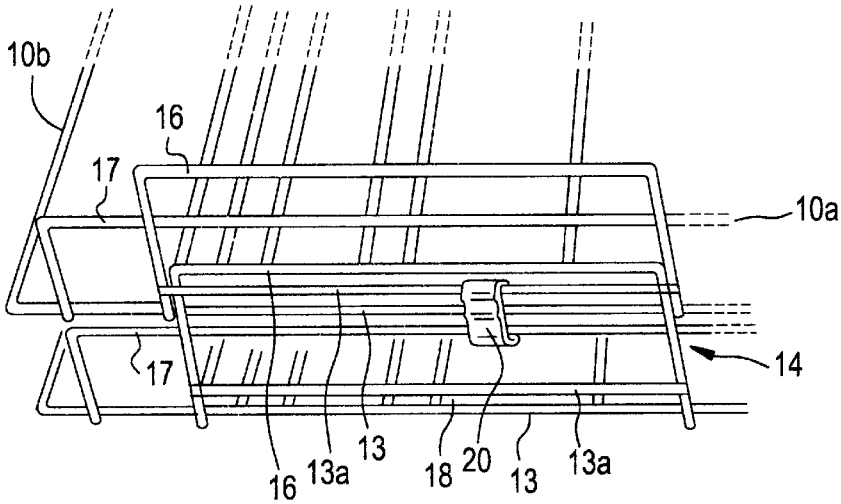

ARTICLE SUPPORTING AND DISPENSING APPARATUS

This is a continuation of application Ser. No. 08/549,625, which was filed Oct. 27, 1995 and is now abandoned.

BACKGROUND OF THE INVENTION

1. Field of the Invention

The present invention relates to an apparatus for supporting and dispensing articles such as bags, and more particularly plastic "T-shirt" type bags having perforations allowing the bags to be easily removed from the apparatus. More specifically, the present invention relates to a plurality of article supporting and dispensing devices that can be stacked for holding and dispensing different sizes of articles such as bags, and preferably, a plurality of bag dispensers being stackable and adjustable for holding and dispensing a plurality of different size bags.

2. Description of the Related Art

Retail establishments typically use a plurality of different size bags for packaging their products sold to consumers. The bags are usually stored on a shelf or other support member provided for all sizes and shapes of bags. If different size bags are placed directly on top of each other it is difficult to retrieve a single bag of a specific shape, length and width in a single motion.

If the different size bags are each stored in separate shelves or on separate support members, the number of shelves and support members is relatively large. Therefore, the space occupied by such a relatively large number of shelves and support members is substantial and wastes valuable point of sale display space.

U.S. Pat. Nos. 5,184,728 and 5,332,097 to Wile teach a plurality of the same size bags being held on a hook located inside of a paperboard cartridge. The bags are of the "T-shirt" type having perforations in the lip so the bags can be torn off of the hook. However, the bag holding device of Wile is not adjustable and cannot hold a plurality of different size bags in such a manner that each of the groups of different size bags are readily accessible. Therefore, a separate paperboard cartridge and hook assembly must be provided for each size bag resulting in inefficient use of space.

U.S. Pat. No. 5,301,832 to Daniels teaches a rack for dispensing plastic bags. Various size bags are draped over a rod and held on stationary wire loop hooks. Each of the various size bags are disposed one on top of each other to form a stack of bags such that the body portions of the bags connected to the bag handles form a stack on the rod. Because of this arrangement, Daniels must provide lubricous surfaces on each of the bags so that the bags located in the stack do not adhere to an adjacent bag when being removed from the rod. In addition, after the bags are draped over the rod, the closure portions of each of the different size bags must be attached to a specific one of the hook loops which makes the mounting of the bags in the bag holder difficult. Furthermore, the top bags must be removed in order to replace the bottom bags.

Million, U.S. Pat. No. 3,312,339 and Dinges, U.S. Pat. No. 3,454,166, merely teach wickets for holding plastic bags having a pair of holes near the handles. With the device of Dinges, two different size bags are placed under the same hooks. Because the two different size bags are stacked on top of each other in Dinges, a large bag being removed has a tendency to adhere to an adjacent smaller bag and inadvertently remove several of the adjacent smaller bags. This effectively limits the number of different size bags to be held by the Dinges device. Furthermore, the top bags must be removed in order to replace the bottom bags. In addition, the wickets in both the Million and Dinges devices must be removed from a support base to mount additional bags on the wickets.

Ondrasik, U.S. Pat. No. 4,821,885 discloses stackable wire trays for stacking and nesting to form a plurality of baskets for holding documents, papers, letters, etc. However, the hooks of Ondrasik are not adjustable or removable. Therefore, the hook positions are set and cannot be changed to accommodate different size articles to be supported thereon.

SUMMARY OF THE INVENTION

The preferred embodiments of the present invention solve the above-noted problems with the prior art bag dispensing devices. One object of the preferred embodiments of the present invention is to provide an article supporting and dispensing apparatus for supporting and dispensing a plurality of different size articles, i.e. bags.

A further object of the preferred embodiments of this invention is to provide article supporting and dispensing devices that are adapted to be stackable with other like devices so as to support a plurality of different size articles or bags in separate areas without occupying an unnecessarily large space.

An additional object of the preferred embodiments of the present invention is to provide a plurality of stackable bag supporting and dispensing devices that form a compact unit for holding a plurality of different size bags in such a manner that each of the different size bags are easily accessible for removal of a single bag of a desired size and can be easily loaded onto the bag supporting and dispensing devices.

A first preferred embodiment of the present invention includes an article supporting and dispensing apparatus having a plurality of racks for holding and dispensing preferably bags having perforations at the lips to thereby allow the bags to be removed from the apparatus. Each of the racks is provided with hooks that are removably and adjustably mounted on the respective racks. The hooks are adapted to be quickly and easily mounted on and removed from each of the racks so that the hooks can be positioned on a respective rack at selected positions to accommodate different size bags or articles. The racks support the hooks for holding the bags and the unhooked ends of the bags.

The racks are adapted to be stackable on other like racks. To achieve the stacking function, each of the racks is preferably provided with a rack insert receiving member and a rack insert member on at least one end portion of the rack. Alternatively, the rack insert receiving member and a rack insert member are provided on opposite end portions of the rack and may even be provided on each of the end portions of the preferably rectangular or square rack. The rack insert receiving member and a rack insert member located at the end portion of the rack are connected to a rack body connecting the end portions of the rack.

In a preferred embodiment, a locking member for locking at least two stacked racks to each other is provided. The locking member is preferably adapted to lock end portions of at least two adjacent stacked racks. The locking member preferably locks via a snap fit and preferably includes a curved lip portion and a rod grasping member which at least partially grasps a rod of one of the end portions of a rack and a rod of an adjacent end portion of a rack.

Alternatively, the locking member may have other suitable rod grasping members or attaching members for removably connecting the locking member to the racks.

The body portion of the rack is arranged to support the hooks for holding the articles and the unhooked ends of the articles. More specifically, the hooks are adapted to be easily mounted on and removed from the body portion of each rack.

In a preferred embodiment, the rack body is formed by a plurality of pairs of rods extending between end portions of the rack. In this preferred embodiment, the hooks have a shape that enable the hooks to snap fit onto adjacent rods. Preferably, the hooks may be placed in a variety of positions on adjacent rods to adjust to different size lengths and widths of bags. Such a snap-fitting shape is provided by a curved lip portion and a rod grasping member which at least partially grasps a rod.

Alternatively, the hooks may have other suitable rod grasping members and attaching members for removably connecting the hooks to the rack body.

In another preferred embodiment, the rack body comprises a perforated board having a plurality of hook receiving holes formed therein. In this preferred embodiment, the hooks include engaging members for engaging the plurality of hook receiving members in the perforated board. This preferred embodiment preferably includes a rack insert receiving member and a rack insert member located at one or more end portions of the rack to allow for stacking of the racks.

The rack body allows for the stacked racks to function as trays for holding articles when the rack bodies of the racks are disposed substantially parallel to the ground. When the rack bodies are arranged to be substantially parallel to a wall surface, the rack bodies function as a wall rack. In either mounting orientation of the stacked racks, the rack bodies support the hooks and the unhooked, free ends of the articles supported on the hooks.

In another preferred embodiment, a housing is provided for accommodating a plurality of racks. The housing is adapted to slidably receive a plurality of racks which when received in the housing, function as trays. Preferably, the housing includes rack holding members for holding a plurality of racks at spaced locations from each other. The rack holding members are preferably formed at edge portions of the housing and extend along a longitudinal direction so as to allow the racks to be slid into the housing. In this preferred embodiment, the rack insert receiving member and a rack insert member located at the end portion of the rack are unnecessary.

Other features and advantages of the preferred embodiments of the present invention will become apparent from the following description of the invention which refers to the accompanying drawings.

BRIEF DESCRIPTION OF THE DRAWINGS

FIG. 5 is a side view of a plurality of stacked racks and locking member of the preferred embodiment; and FIG. 6 is a side view of an alternative preferred embodiment of a housing for housing a plurality of racks forming an alternate embodiment of the article dispensing apparatus.

DETAILED DESCRIPTION OF THE INVENTION

Figure 1:
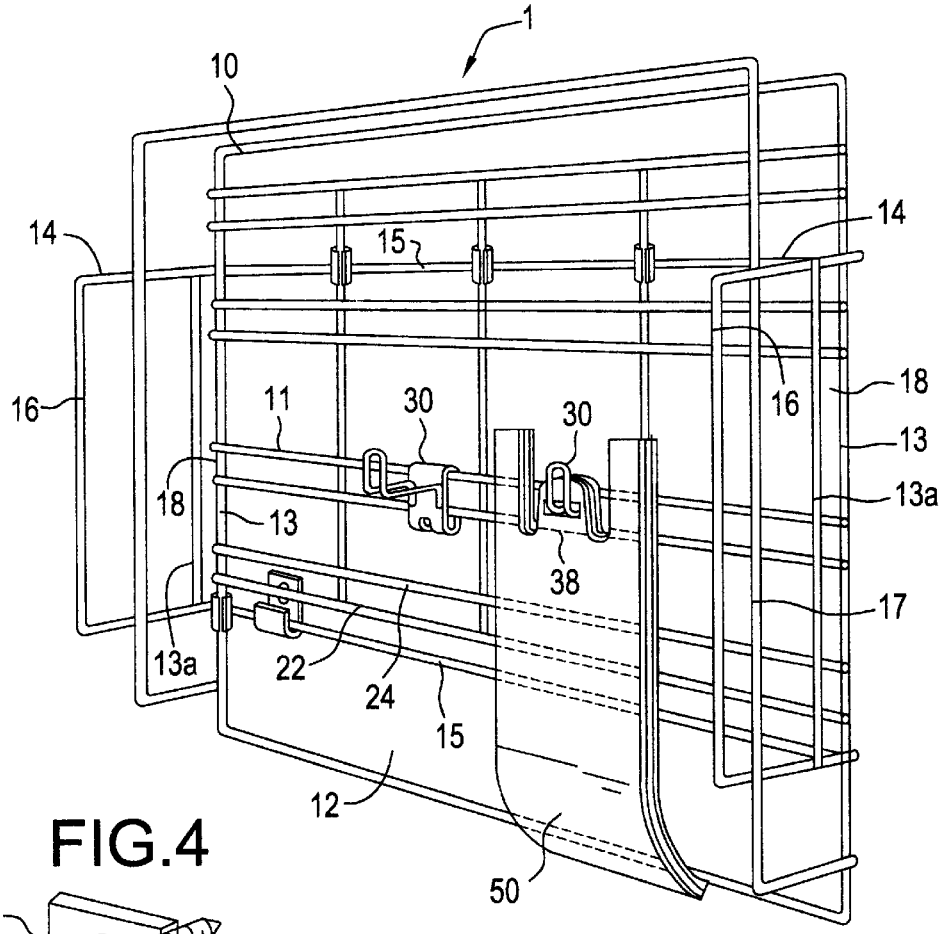
FIG. 1 is a top view of a preferred embodiment of the article dispensing apparatus of the present invention.

FIG. 1 shows a preferred embodiment of the article supporting and dispensing apparatus 1 according to the present invention. The article supporting and dispensing apparatus 1 includes a plurality of racks 10 for holding and dispensing articles, preferably bags having perforations at the lips thereof to allow the bags to be easily removed one-by-one from the apparatus. The rack 10 preferably is formed of a plurality of interconnected rod members 11. The rod members 11 may be formed of steel, aluminum, any other suitable metal, plastic, wood, and any other suitable material.

The rack 10 includes a front open portion 12. The rack 10 can be placed on a counter or shelf with the open potion of the rack 12 placed at the front. The rack 10 also includes end portions 14 disposed at either end of the rack 10. Each end portion 14 includes a rack insert receiving member 18 and a rack insert member 16. The rack insert receiving member 18 preferably comprises a space between a plurality of the rods 13 and 13*a*. The rod 13*a* is a side guard which prevents the rack from shifting when stacked. The space comprising the rack insert receiving member 18 is preferably adapted to receive in a press-fit manner a rack insert member 16 of an adjacent rack 10.

The rack insert member 16 preferably is formed by rod member 15 which extends beneath the rack 10 between end portions 14 and then protrudes substantially perpendicularly from the rack 10 to form rack insert member 16. The rod members 15 preferably provide elevation to rack 10 so that the hook members 30 are easily removed and attached to the rack 10 without interfering with the surface beneath the rack 10. Further rod member 15 is designed to allow mounting member 32 to grasp rod 15 without interfering with the attachment of hook members 30. The rack insert member 16 is preferably arranged to be press-fitted in a rack insert receiving member 18 of an adjacent rack 10.

In a preferred embodiment, the rack 10 may include a locking member 20 which is preferably located at at least one end portion 14 of the rack 10. The locking member 20 preferably comprises a locking mechanism that is adapted to engage with a rod member 13*a* of one rack 10 and a rod member 17 of an adjacent rack 10. The lock member 20 preferably locks rod members 13*a* and 17 via a snap fit.

Figure 3:
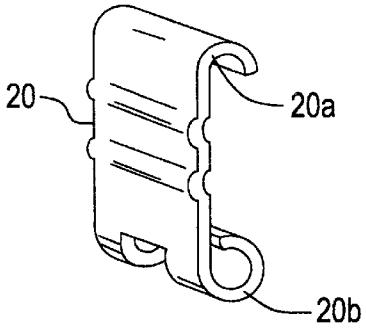
FIG. 3 is a perspective side view of a preferred embodiment of the locking member preferably used with the dispensing apparatus shown in FIG. 1.

A preferred embodiment of the locking member 20 is shown in FIG. 3. The locking member 20 preferably includes a rod grasping member 20*a* and a curved lip portion 20*b*. The rod grasping member 20*a* is adapted and arranged to grasp at least one rod member 13*a* of the rack 10. The curved lip portion 20*b* is located at a distance from the rod grasping member 20*a* and arranged so that the curved lip portion 20*b* engages with at least one rod member 17 of an adjacent rack 10. The locking member 20 is preferably constructed so that the rod members 13*a* and 17 fit between the rod grasping member 20*a* and the curved lip portion 20*b*.

Figure 2:
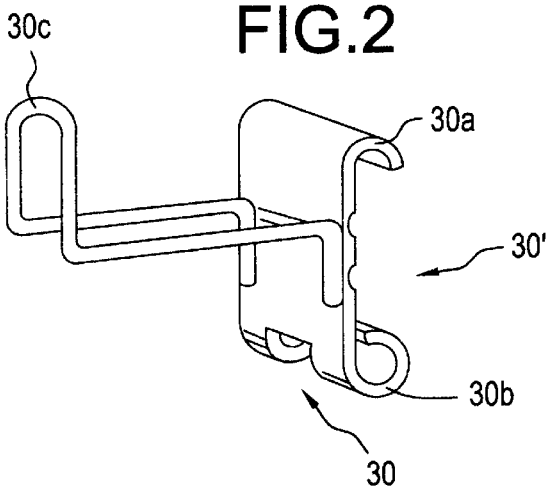
FIG. 2 is a perspective side view of a preferred embodiment of the hooks for holding articles on the dispensing apparatus preferably used with the dispensing apparatus shown in FIG. 1.

A plurality of hook members 30 shown in FIG. 2 are provided to be removably mounted on the rod members 11 of the rack 10. A preferred embodiment of the hook member 30 is shown in FIG. 2. The preferred embodiment of the hook member 30 is preferably formed to be similar to the locking member 20. More specifically, the hook member 30 has a grasping portion 30' including a rod grasping member

30*a* and a curved lip portion 30*b*. The rod grasping member 30*a* is adapted and arranged to grasp at least one of the adjacent rod members 11 disposed substantially parallel to each other as shown in FIG. 1. The curved lip portion 30*b* is located at a distance from the rod grasping member 30*a* and arranged so that the curved lip portion 30*b* engages with at least one of the other rod members 11 of the adjacent rod members 11.

Although the rod members 11 are shown in FIG. 1 to be disposed in sets of pairs and the hook member 30 is preferably arranged to grasp one set of pairs of rod members 11, many alternative arrangements of the rod members 11 and the hook members 30 are possible. For example, the rod members 11 may be arranged in groups of three, four or more and the hook members 30 can be easily adapted to removably engage with the three, four or more rod members 11 in a group. In addition, the grasping part 30' of the hook member 30 can include an alternative structure that is capable of grasping one or more of the rod members 11 so as to secure the hook member 30 to the rack 10.

The hook memberhook member 30 also includes a hook portion 30*c* which is preferably formed by at least two substantially parallel rod members. The hook portion 30*c* can be arranged to accommodate any type of article to be supported and dispensed.

The above-described structure of the hook member 30 and the arrangement of the rod members 11 allow a plurality of hook members 30 to be easily and quickly mounted and removed from the rack 10. This allows the rack 10 to provide any number of supporting configurations because any number of hook members 30 can be mounted on any location of the rod members 11.

Figure 4:
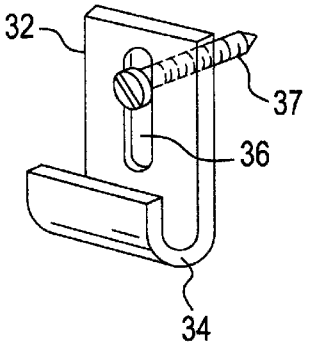
FIG. 4 is a front view of a preferred embodiment of a mounting apparatus for mounting the dispensing apparatus shown in FIG. 1 onto a support surface.

FIG. 4 shows a preferred embodiment of a mounting member 32 for mounting a rack 10 on a support surface. The mounting member 32 includes a rod supporting member 34 which is shaped to support one of the rods 15. The mounting member 32 also includes a hole 36 for receiving a fastener 37 such as a nail or screw. Mounting foam or any other suitable mounting device may also be used. The mount hole 36 is positioned on a horizontal or vertical support surface so as to mount the rack 10 on that surface. With the mounting member 32, one or more racks 10 can be mounted on a wall, counter, under a counter or any other suitable location.

FIG. 1 further shows a single rack 10 having a plurality of bags 50 being held on a hook member 30. The hook member 30 is arranged so that the bags 50 hang over the front of the rack open portion 12. The location of the hook members 30 can be adjusted to accommodate various sizes of bags 50. It is preferred that bags 50 that are short are placed on adjustable hooks 30 that are placed on horizontal rods 22 and 24 that are closer to the front end of the rack 10. Bags 50 that are longer are placed on adjustable hooks 30 further from the rack open portion 12 than the bags 50 that are shorter. Bags 50 are preferably loaded onto the hook member 30 in gangs of the same size. The bags 50 are torn off the hooks 30 at perforations 38.

FIG. 5 shows a preferred embodiment of the stackable racks 10 in which at least two racks 10 are stacked on top of each other. As can be seen in FIG. 5, the rack insert member 16 is press-fittingly engaged in the rack insert receiving member 18 of the adjacent rack 10. The preferred embodiment shown in FIG. 5 also includes a locking member 20 for locking the two racks 10 to each other.

It should be noted that FIG. 5 only shows one of the end portions 14 of the racks 10. The rack insert member 16 and the rack insert receiving member 18 may be provided on one or both of the end portions of the racks 10. Alternatively, the rack insert member 16 and the rack insert receiving member 18 may be provided on one or both of the front and rear portions 10*a*, 10*b* of the racks 10, which connect the end portions 14 of the racks 10. If a more stable connection between the racks 10 is desired, each rack 10 could have a rack insert member 16 and a rack insert receiving member 18 provided on each of the end portions 14 and on each of the front and rear portions 10*a*, and 10*b*.

In a further alternative embodiment shown in FIG. 6, a housing 60 is provided. The housing 60 is preferably formed by a plurality of rods 11 and includes a plurality of rack holding members 62 preferably in the form of inwardly protruding rods which define a plurality of shelf-like members.

A plurality of racks 64 are adapted to be engaged with the rack holding members 62 in the housing 60. The racks 64 are preferably formed of rod members 11 disposed substantially parallel to each other in horizontal and vertical directions. The racks 64 shown in FIG. 6 do not include the rack insert receiving members 18 and the rack insert members 16 of the previous preferred embodiments. These members 16, 18 are unnecessary because of the rack holding members 62.

Rack holding members 62 are offset so that when extension 66 of rack 64 is slid into housing 60, the extension 66 slips behind holding member 62 so the racks 64 do not slide out of the housing 60.

The racks 64 are slid into place on a respective rod holding member 62 in the housing. In this preferred embodiment, the hooks 30 are removably mounted to the rods 11 of the racks 64 and the bags 50 are placed on the hooks 30 which are fastened to the racks 64 prior to the racks 64 being placed on the rack holding member 62. When no more bags 50 are remaining on one of the hooks 30, the appropriate rack 64 is removed from the rack holding members 62 in order to restack the hook 30 with bags 50.

The present invention is not limited to the preferred embodiments described above. For example, it is possible to form a rack 10 from a perforated board, wood, metal or other suitable material, having a plurality of hook receiving holes formed therein. In such an embodiment, the hooks include engaging members for engaging in the plurality of hook receiving members in the perforated board. This alternative embodiment preferably includes a rack insert receiving member and a rack insert member located at one or more end portions of the rack to allow for stacking of the racks.

Although the preferred embodiments of the present invention has been described and illustrate in detail, it is clearly understood that the same is only by way illustration and example and is not to be taken by way of limitation as only limitation on the spirit and scope of the present invention is in the terms of the appended claims.

What is claimed is:

1. An apparatus for supporting and dispensing articles comprising:

A plurality of racks each including a rack body including a plurality of interconnected rods arranged to define an article supporting surface, an open front portion of said rack wherein said articles can be dispensed from, a portion of the plurality of rods extending upwardly from the article supporting surface to define at least one rack insert member and at least one rack insert receiving member, said racks being stacked on top of each other to form an integral stacked unit such that rack insert member of one of said plurality of racks is engaged in said rack insert receiving member of an adjacent one of said plurality of racks so that said rack having said rack insert receiving member is integrally stacked and located within said rack having said insert member such that said rack body of said rack having said rack insert receiving member is located within said rack body of said rack having said rack insert member; and A plurality of hook members removably attached to said article supporting surfaces of said racks and being arranged on said article supporting surface of each of said racks such that first portions of articles supported on said hook members are suspended from said hook members and second portions of articles supported on said hook members are supported by a respective article supporting surface of each of said racks, each of said hook members having a rack engaging member arranged such that each of said plurality of hook members are capable of being attached to any location on said article supporting surface on said rack body of each of said plurality of racks.

2. The apparatus for supporting and dispensing articles according to claim 1, wherein said plurality of rods are arranged in multiple groups of two rods disposed substantially parallel to each other and said hook members are arranged to be attached to each of said groups of two rods.

3. The apparatus for supporting and dispensing articles according to claim 1, further comprising a mounting device for mounting said integral stacked unit on a support surface.

4. The apparatus for supporting and dispensing articles according to claim 1, wherein said rack insert receiving member comprises a space formed between said rods.

5. The apparatus for supporting and dispensing articles according to claim 1, further comprising at least one locking device for locking adjacent ones of said racks forming said stacked rack unit to each other.

6. The apparatus for supporting and dispensing articles according to claim 5, wherein said at least one locking device comprises at least one rod grasping member and a curved lip portion arranged such that said at least one locking device snaps onto at least two rods of adjacent ones of said plurality of racks.

7. The apparatus for supporting and dispensing articles according to claim 1, wherein each of said hook members comprises at least one rod grasping member and a curved lip portion arranged such that each of said hook members snaps onto at least two adjacent rods of one of said plurality of racks.

8. The apparatus for supporting and dispensing articles according to claim 1, wherein at least one of said hook members is arranged on one of said racks such that an article supported on said at least one of said hook members extends beyond said rack body of said one of said racks.

9. The apparatus for supporting and dispensing articles according to claim 1, wherein a plurality of groups of different size plastic bags are supported on said hook members and said hook members are arranged such that each of said groups of different size plastic bags is spaced from the other groups of different size plastic bags.

* * * * *